United States Patent [19]

Tommi et al.

[11] Patent Number: 4,757,611

[45] Date of Patent: Jul. 19, 1988

[54] COIN ROLL CUTTER

[76] Inventors: Dean J. Tommi, P.O. Box 232, 19 Grobe Ave., Cologne, N.J. 08213; Michael Weisbecker, 135 Philadelphia Ave., Egg Harbor, N.J. 08215

[21] Appl. No.: 9,838

[22] Filed: Feb. 2, 1987

[51] Int. Cl.[4] ..... B67B 7/00

[52] U.S. Cl. ..... 30/2; 30/286

[58] Field of Search ..... 30/2, 151, 333, 332, 30/329, 286

[56] References Cited

U.S. PATENT DOCUMENTS 2,743,523 5/1956 Homey ..... 30/2

4,531,286 7/1985 Vito et al. ..... 30/2

4,567,655 2/1986 Jacobs ..... 30/2

*Primary Examiner*—Douglas D. Watts

*Attorney, Agent, or Firm*—Robert K. Youtie

[57] ABSTRACT

A coin roll cutter comprising a body to be clasped in a user's hand, an arcuate member adjacent to and normally spaced from the body and having one end connected to the body for swinging movement of the arcuate member toward and away from the body, and a cutter extending from the body into and terminating within the arcuate member when the latter is in its normal position, swinging movement of the arcuate member, as by a coin roll engaged in the concave side of the arcuate member serves to project the cutter beyond the arcuate member into cutting engagement with the wrapper for the coin roll.

8 Claims, 1 Drawing Sheet

FIG. 1
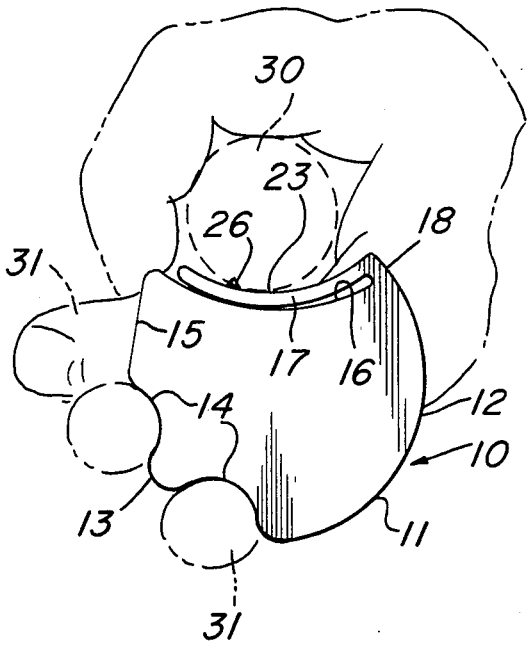
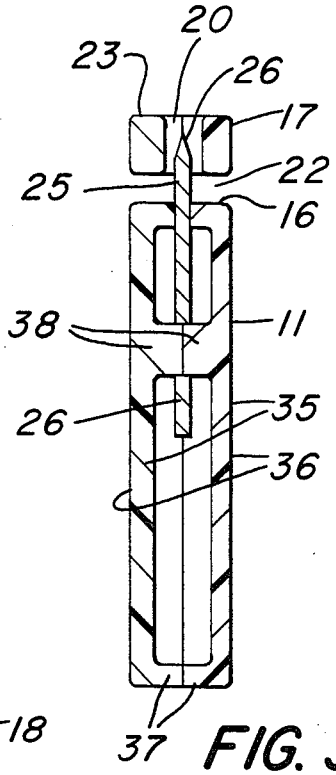
FIG. 3
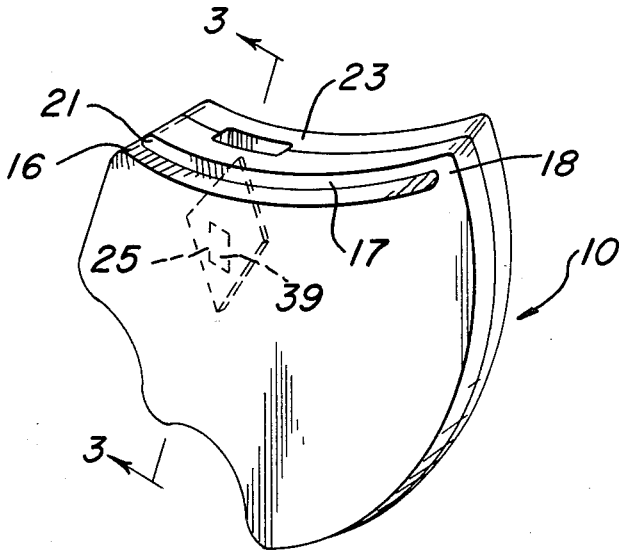
FIG. 2

COIN ROLL CUTTER

BACKGROUND OF THE INVENTION

While there are a variety of cutlery implements for opening various packages and containers, the prior art devices are all relatively complex in construction and operation, as compared to applicant's instant device.

Applicants are aware of the below listed prior patents:

| U.S. Pat. No. | Dated | Patentee |
|---|---|---|
| 1,102,124 | June 30, 1914 | L. Baptiste |
| 1,109,286 | Sept. 1, 1914 | L. R. Hagen |
| 2,262,000 | Nov. 11, 1941 | J. Hjort |
| 2,276,268 | Mar. 17, 1942 | W. J. Donlon |
| 2,578,404 | Dec. 11, 1951 | C. F. Dimitruk |
| 2,722,736 | Nov. 8, 1955 | J. W. Svalgaard |
| 2,896,317 | July 28, 1959 | V. A. Vaive |
| 4,567,655 | Feb. 4, 1986 | D. C. Jacobs |

SUMMARY OF THE INVENTION

It is an important object of the present invention to provide a cutter or opener for wrapped or packaged coins which is extremely simple in construction, small and light in weight, as for convenient carrying in a pocket, on a keychain or the like.

It is a further object of the present invention to provide an implement for opening wrapped rolls of coin, which implement is extremely quick and easy to operate for opening coin rolls without unseemly banging or other indecorous behaviour.

It is a further object of the present invention to provide a coin roll opener having the advantageous characteristics mentioned in the preceeding paragraphs which is staunch and sturdy in construction for a long useful life, and which may afford opportunity for the sale of advertising space, to even further reduce cost to the consumer.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is an elevational view showing a coin roll cutter of the present invention in operative condition, a user's hand and a coin roll being shown in phantom.

FIG. 2 is a perspective view showing the coin roll cutter of the present invention in an inoperative or rest condition.

FIG. 3 is a transverse sectional view taken generally along the line 3—3 of FIG. 2.

DESCRIPTION OF THE PREFERRED EMBODIMENT

Referring now more particularly to the drawings, and specifically to FIGS. 1 and 2 thereof, the coin roll cutter of the present invention is there generally designated 10, and may include a body 11 of a generally flat or planar configuration. By way of example and without limitation thereto the body 10 is of generally a mutilated circular configuration including an arcuately convex edge portion 12 which extends into or merges with a generally sinusoidal edge portion 13 which may be characterized by spaced finger notches 14. Extending from the sinusoidal edge portion 13 remote from the arcuate edge portion 12 may be an additional arcuately convex edge portion 15.

The arcuate edge portion 15 may be of lesser extent than the arcuate edge portion 12; and extending generally between the convexly arcuate edge portions 15 and 12 may be a concavely arcuate edge portion 16. As shown in FIGS. 1 and 2, the finger engaging edge portion 13 may be generally on the lower side of the body 11, while the concavely arcuate edge portion 16 may be generally on the upper side of the body.

As seen in FIG. 2, there is an elongate arm or bearing member 17 conformably spaced over the concavely arcuate edge portion 16 and mounted to the body 11 by an integral connection 18 between one end of the engaging member 17 and the body at the edge portion 12.

The arcuate arm or bearing member 17 is thus on the opposite side of the body 11 as the finger engaging body portion 13 and is located in a normally spaced, conforming relation with respect to the concave body edge portion 16 so that the concave side of the arm or bearing member faces upwardly or outwardly away from the body. The arm or bearing member 17 is thus generally in the plane of the body 11, or co-planar therewith, and swingably connected to the body, for the purpose appearing presently.

As best seen in FIGS. 2 and 3, the bearing member or arm 17 is provided with a through opening or hole 20 located adjacent to and spaced inward from the free end 21 of the bearing member, the hole 20 defining a passageway opening from the space 22 between the body 11 and arm 17 through and out of the concave side 23 of the arm.

A cutting element, knife or blade 25 may be anchored at one end 26 interiorly of the body 11 and extend therefrom outwardly through the upper concave edge portion 16. The cutting element or blade 25 extends from the body 11 in alignment with the passageway or slot 20 of the bearing member or arm 17 and enters into the passageway, the distal end 26 of the cutter terminating in the passageway 20 when the arm 17 is in its normal rest position spaced from the body 11, as seen in FIGS. 2 and 3.

However, upon resilient swinging of the arm 17, as by deflection of the mount or connection 18 to move the arm into engagement with the concave body edge portion 16, as seen in FIG. 1, it will be apparent that the termination or point 26 of the cutter 25 projects from the arm 17 beyond the concave side 23 of the arm.

In use, as seen in FIG. 1, a wrapped roll of coins is shown at 30 in bearing engagement with the outer, concave side 23 of the arm 17. A user's fingers 31 may be engaged in the notches 14, and the remainder of the user's hand, as at 32 located over the coin roll 30. In this condition, the hand may squeeze together the coin roll 30 and body 11 to flex the mounting connection 18 and swing the arm 17 into engagement with the body edge 16 for projection through the arm of the cutter point 26 for impaling into wrapper of the coin roll 30.

This mere squeezing may be sufficient to initiate severance of the coin roll wrapper, whereupon the coin roll may be readily bent in two for access to the coins. If desired, the coin roll may be rotated in engagement with the bearing member 17 as seen in FIG. 2 for effecting an elongate cut in the wrapper, which will, of itself upon the coin roll.

In practice, the body 11, integral, resilient hinge 18 and arm 17 may be integrally fabricated of a pair of complementary sections 35. The pair of sections 35 may be substantially identical, but of opposite hand, each section including a hollow body portion 36 bounded by a peripheral inturned flange 37, which flanges are suitably secured together, as by adhesive, plastic welding, or the like. In addition, a pair of internal bosses 38 may be provided in the complementary body sections 36 for engagement through a non-circular opening 39 in the cutter or blade 25, to effectively fix the latter in position relative to the body 11. The arm 17 may also be composed of complementary sections suitably secured together, and integrally connected by the hinge 18 to the body 11.

While it is contemplated that the complementary sections 35 be economically mass produced, as by injection molding of plastic, other suitable manufacture may be employed, if desired.

Although the present invention has been described in some detail by way of illustration anbd example for purposes of clarity of understanding, it is understood that certain changes and modifications may be made within the spirit of the invention.

What is claimed is:

1. A hand implement for opening a wrapped coin roll, said implement comprising a generally circular body sized to be held in the palm of a user's hand and having one side configured for engagement with the palm side of a user's fingers, the other side of said body being concavely arcuately cut-away, an arcuate bearing member along the cut-away on the other side of and spaced from said body and being outwardly concave for receiving engagement with a coin roll, mounting means mounting said bearing member to said body for resilient yielding movement towards said body upon forceable engagement of a coin roll in said bearing member, and a cutting element extending from the other side of said body into said bearing member and having a cutting edge received in said bearing member when the latter is spaced from said body, said cutting edge projecting through and beyond said bearing member upon said forceable engagement to impale and cut a coin roll wrapper.

2. A hand implement according to claim 1, said one side of said body having a sinusoidal configuration for said finger engagement.

3. A hand implement according to claim 1, said arcuate bearing member having a convex side facing toward and extending conformably along the cut-away of said body, for nesting of the coin roll, bearing member and cut-away of said body to facilitate manually squeezing said body and coin roll engaging said member to effect said cutting.

4. A hand implement according to claim 3, said mounting means comprising a resilient connection between said body and one end of said bearing member, to mount the latter for swinging movement in said conforming relation toward and away from said body, the other end of said bearing member being free.

5. A hand implement according to claim 4, said body being generally flat, and said bearing member being generally in the plane of said body.

6. A hand implement according to claim 4, said body being generally planar and said bearing member being generally co-planar with said body.

7. A hand implement according to claim 6, said body, resilient connection and bearing member comprising a pair of integrally molded complementary mating sections in congruent facing relation with each other.

8. A hand implement according to claim 7, said cutting element comprising a blade having an anchor portion fixed between said sections, and said cutting edge extending from said anchor portion into said bearing member when the latter is at rest.

* * * * *